US008931280B2

(12) United States Patent
Kaleeswaran et al.

(10) Patent No.: US 8,931,280 B2
(45) Date of Patent: Jan. 13, 2015

(54) FULLY IMPINGEMENT COOLED VENTURI WITH INBUILT RESONATOR FOR REDUCED DYNAMICS AND BETTER HEAT TRANSFER CAPABILITIES

(75) Inventors: Karthick Kaleeswaran, Bangalore (IN); Kodukulla Venkat Sridhar, Bangalore (IN); James Butts, Simpsonville, SC (US); Bhaskara Rao Atchuta, Bangalore (IN); Prabhu Kumar Ippadi Siddagangaiah, Bangalore (IN)

(73) Assignee: General Electric Company, Schenectady, NY (US)

( * ) Notice: Subject to any disclaimer, the term of this patent is extended or adjusted under 35 U.S.C. 154(b) by 932 days.

(21) Appl. No.: 13/094,160

(22) Filed: Apr. 26, 2011

(65) Prior Publication Data

US 2012/0272654 A1 Nov. 1, 2012

(51) Int. Cl.
*F23R 3/04* (2006.01)
*F23R 3/00* (2006.01)

(52) U.S. Cl.
CPC ..... *F23R 3/002* (2013.01); *F23R 2900/03044* (2013.01)
USPC ..... 60/752; 60/757; 60/754

(58) Field of Classification Search
CPC ..... F23R 3/002; F23R 3/06; F23R 3/08; F23R 2900/03044; F05D 2260/201
USPC ..... 60/737, 746, 747, 748, 752, 754, 755, 60/757
See application file for complete search history.

(56) References Cited

U.S. PATENT DOCUMENTS

| | | | | |
|---|---|---|---|---|
| 2,958,194 | A * | 11/1960 | Bayler | 60/760 |
| 5,117,636 | A | 6/1992 | Bechtel, II et al. | |
| 5,253,478 | A * | 10/1993 | Thibault et al. | 60/753 |
| 5,479,782 | A * | 1/1996 | Parker et al. | 60/747 |
| 6,430,932 | B1 | 8/2002 | Martling et al. | |
| 6,446,438 | B1 | 9/2002 | Kraft et al. | |
| 6,640,547 | B2 * | 11/2003 | Leahy, Jr. | 60/757 |
| 7,194,862 | B2 | 3/2007 | Sattinger | |
| 7,270,175 | B2 * | 9/2007 | Mayer et al. | 165/47 |
| 2005/0144954 | A1 | 7/2005 | Lemon et al. | |
| 2006/0168967 | A1 * | 8/2006 | Simons et al. | 60/752 |
| 2008/0295521 | A1 | 12/2008 | Simons et al. | |
| 2009/0019854 | A1 * | 1/2009 | Simons et al. | 60/752 |
| 2010/0251722 | A1 * | 10/2010 | Woolford et al. | 60/755 |
| 2011/0247340 | A1 * | 10/2011 | Popovic et al. | 60/752 |

OTHER PUBLICATIONS

Search Report and Written Opinion from EP Application No. 12164826.5 dated Aug. 2, 2012.

* cited by examiner

*Primary Examiner* — Ted Kim
(74) *Attorney, Agent, or Firm* — Nixon & Vanderhye, P.C.

(57) ABSTRACT

A venturi assembly for a turbine combustor includes a first outer annular wall and a second intermediate annular wall radially spaced from each other in substantially concentric relationship. The first outer annular wall and said second intermediate annular wall shaped to define a forward, substantially V-shaped throat region, and an aft, axially extending portion. A third radially innermost annular wall is connected to the second intermediate annular wall at an aft end of said throat region. A first plurality of apertures is provided in the first outer annular wall in the substantially V-shaped throat region, and a second plurality of apertures is provided in the aft, axially extending portion of said second intermediate annular wall so that cooling air flows through the first and second pluralities of apertures to impingement cool the third radially innermost annular wall.

17 Claims, 5 Drawing Sheets

FULLY IMPINGEMENT COOLED VENTURI WITH INBUILT RESONATOR FOR REDUCED DYNAMICS AND BETTER HEAT TRANSFER CAPABILITIES

BACKGROUND

The present invention relates generally to an apparatus and method for cooling a venturi used in the combustion chamber of dry-low NOx gas turbine engine combustors.

In a typical dual-stage, dual-mode gas turbine engine a secondary combustor includes a venturi configuration to stabilize the combustion flame. Fuel (natural gas or liquid) and air are premixed in the combustor premix chamber upstream of the venturi and the air/fuel mixture is fired or combusted downstream of the venturi throat. The venturi configuration accelerates the air/fuel flow through the throat and ideally keeps the flame from flashing back into the premix region. The flame-holding region is necessary for continuous and stable fuel burning. The combustion chamber wall and the venturi walls before and after the throat region are heated by a combustion flame and therefore must be cooled. In the past, the venturi has been impingement-cooled by combustor discharge air at the forward end, and turbulator-cooled in an axially aft portion of the venturi, downstream of the throat region.

In recent tests of certain turbine engines, however, it has been observed that vortex shedding at the venturi dump (where the venturi cooling air joins with the combustion gases exiting the combustor) has a tendency to interact with the flame and produces dynamics, or screech tones. These vortices are shed from the venturi turbulators and preliminary indications suggest that eliminating the turbulators at the aft portion of the venturi assembly will lead to a reduction or elimination of the vortex shedding, and thus also a reduction in screech tone frequencies.

BRIEF SUMMARY OF THE INVENTION

The invention is concerned with cooling the gas turbine combustion chamber, and specifically, cooling the inner (or hot side) wall of the venturi located within the combustion chamber and reducing screech-tone venturi dynamics.

In an exemplary but nonlimiting embodiment of this invention, there is provided a venturi assembly for a turbine combustor comprising a first outer annular wall and a second intermediate annular wall radially spaced from each other in substantially concentric relationship, said first outer annular wall and said second intermediate annular wall shaped to define a forward, substantially V-shaped throat region, and an aft, axially extending portion; a third radially innermost annular wall connected to said second intermediate annular wall at an aft end of said throat region; a first plurality of apertures in said first outer annular wall in said substantially V-shaped throat region; and a second plurality of apertures in said second intermediate annular wall along said aft, axially extending portion.

In another aspect, the exemplary but nonlimiting embodiment, there is provided turbine combustor comprising a substantially cylindrical combustor liner defining a combustion chamber; and an annular venturi assembly secured to an inner surface of the combustor liner; the venturi assembly comprising a first outer annular wall and a second intermediate annular wall radially spaced from each other in substantially concentric relationship, the first outer annular wall and the second intermediate annular wall shaped to define a forward, substantially V-shaped throat region and an aft, axially extending portion; a third inner annular wall radially inward of the second intermediate annular wall and connected to the second intermediate annular wall at an aft end of the throat region; a first plurality of apertures in the first outer annular wall in the substantially v-shaped throat region; and a second plurality of apertures in the second intermediate annular wall along the aft, axially extending portion.

In still another aspect, the exemplary but nonlimiting embodiment, there is provided a method of cooling a venturi assembly in a turbine combustor, the venturi assembly having a forward throat region and an aft, axially extending portion the method comprising establishing a first radially outer coolant flow path extending from the throat region through an aft end of the aft, axially-extending portion; establishing a second radially inner coolant flow path extending only along the aft, axially extending portion; providing a first plurality of impingement cooling holes in the throat region to supply cooling air to the first radially outer coolant flow path and a second plurality of impingement cooling holes in the aft, axially-extending portion to supply cooling air from the first radially outer coolant flow path to the second radially inner coolant flow path; and flowing cooling air into the first radially outer coolant flow path through the first plurality of impingement cooling holes, and then into the second radially inner coolant flow path through the second plurality of impingement cooling holes to thereby impingement cool a radially innermost wall of the aft, axially-extending portion of the venture assembly.

The invention will now be described in detail in connection with the drawings identified below.

DETAILED DESCRIPTION OF THE INVENTION

Figure 1:
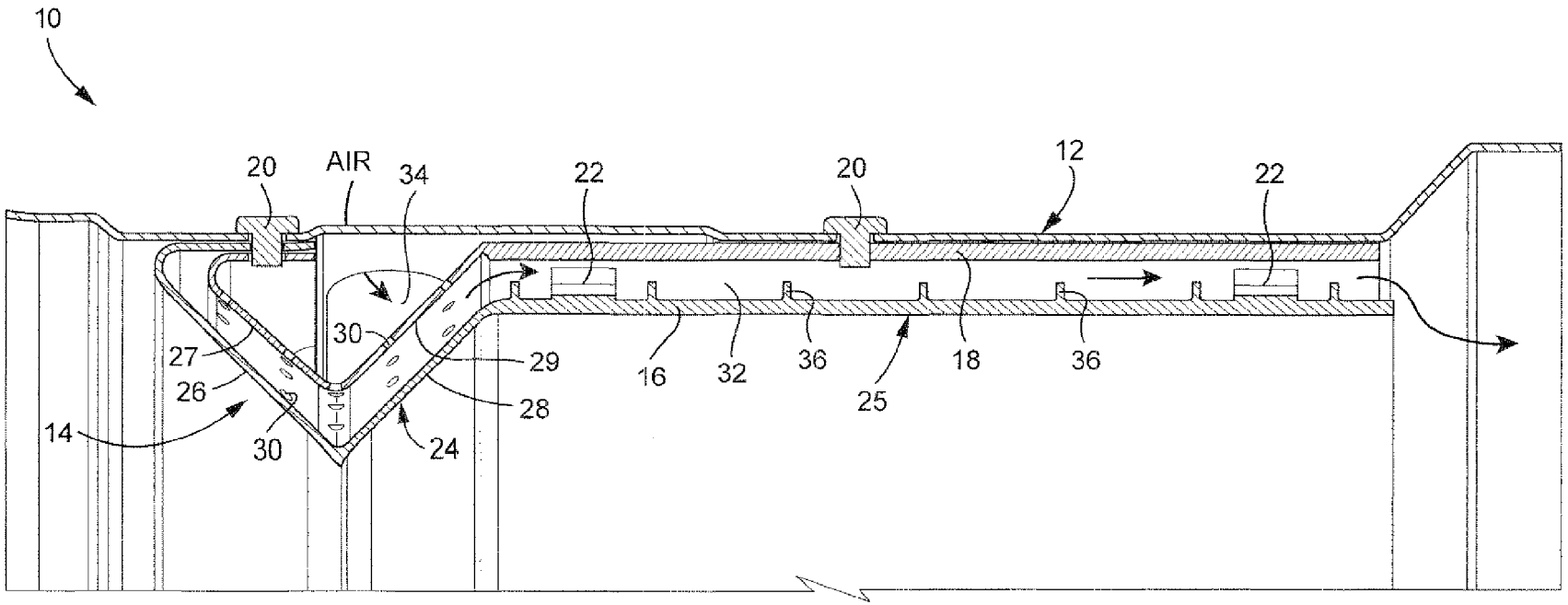
FIG. 1 (Prior Art)
FIG. 1 is a partial cross-section of a combustor and known venturi assembly.
Figure 2:
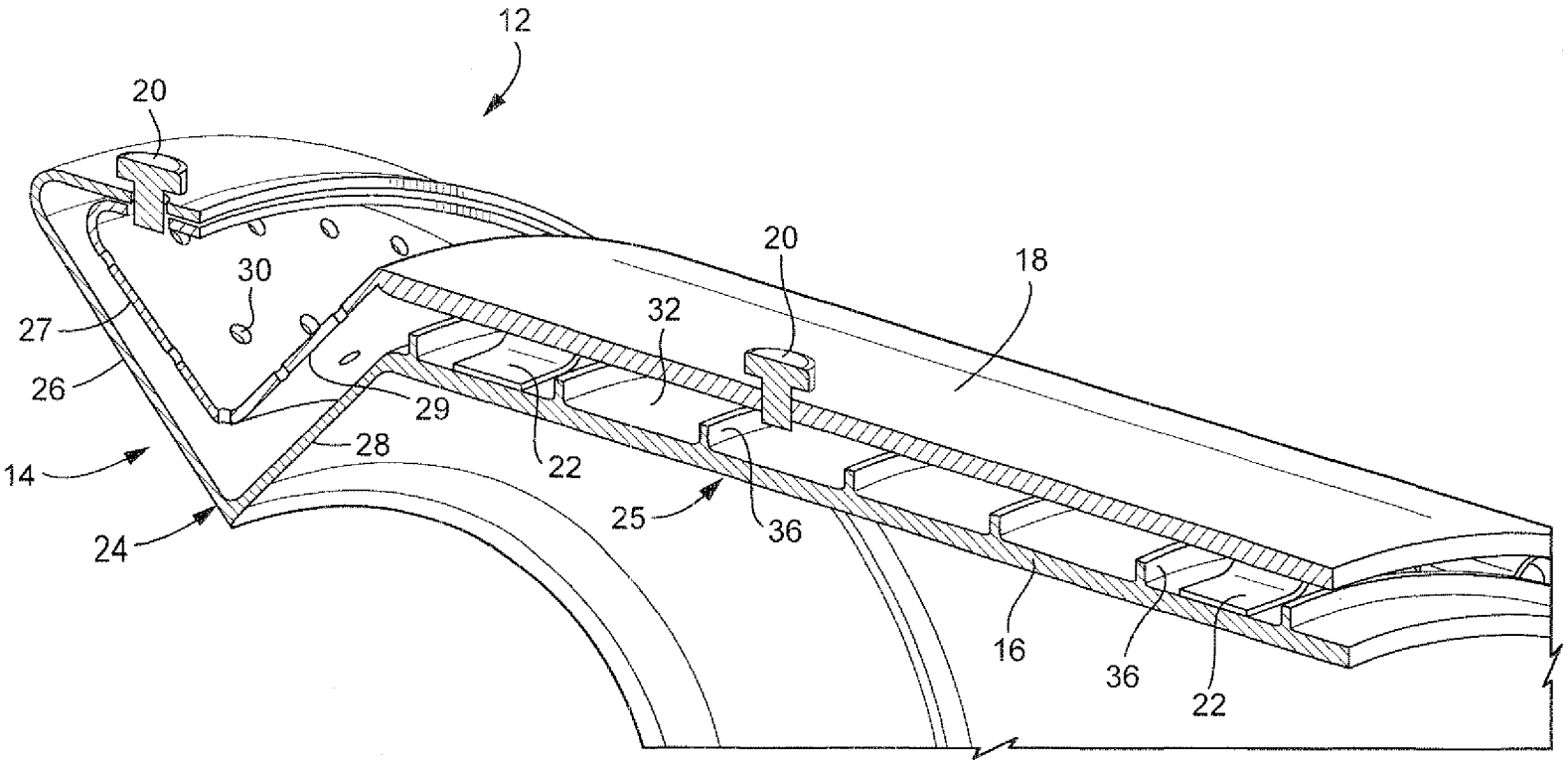
FIG. 2 (Prior Art)
FIG. 2 is a sectioned partial perspective view of the venturi assembly shown in FIG. 1, but removed from the combustor.

With reference initially to FIGS. 1 and 2, a combustor 10 includes a combustor liner 12 of generally cylindrical shape, and defining a combustion chamber. A venturi assembly 14 is located on the interior or hot side of the combustor liner 12. The venturi assembly 14 includes an inner or hot side wall 16, and an outer or cold side wall 18. The venturi assembly is secured to the combustor liner 12 by means of rivets 20 or other suitable means. Between the inner and outer side walls 16, 18, there are a plurality of arcuate wall separators or supports 22 welded at opposite ends to the inner side wall 16, but with a small radial gap between a radially-outwardly-bowed center portion of the separator and the outer venturi side wall when cold, so as to accommodate thermal growth during operation. A throat region 24 of the venturi assembly includes forward angled wall sections 26, 27 and aft angled wall sections 28, 29 which together form the substantially v-shape of the throat region 24. Impingement holes 30 are provided in the outer side wall 18 in the forward and aft wall section 27, 29 thus permitting compressor discharge air to pass through the impingement holes and into a first coolant flow path or passage 32 located radially between the inner and outer walls 16, 18. The compressor discharge air enters the throat region 24 through arcuate openings or slots 34 formed in the combustor liner (one partially shown in FIG. 1). The air flows through the impingement holes 38 and impingement cools the hot inner forward and aft wall sections 26, 28 of the throat region 24 of the venturi and then flows along the axially-extending portion 25 of the venturi assembly 14 via passage 32. Note that the passage is closed at the forwardmost end of the venturi assembly where the forward, angled wall sections 26, 27 are joined by the rivets or other fasteners 20. During flow in a downstream direction, the cooling air passes over a plurality of annular turbulators 36, axially-spaced along the inner hot side wall 16 in the axial, aft section of the passage 32. The air exits the open aft end of the venturi assembly 14 to mix with the combustion gases flowing out of the combustion chamber and toward the first stage of the turbine by means of a transition piece or duct, not shown.

Figure 3:
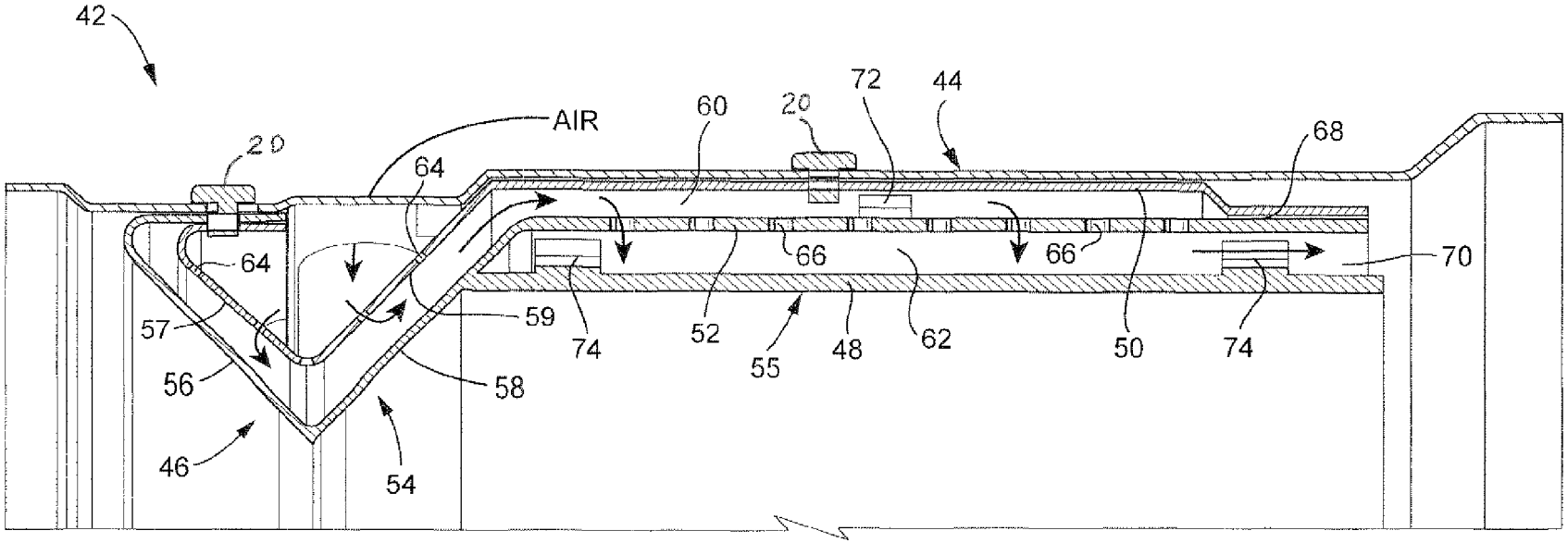
FIG. 3 is a partial cross-section of a combustor incorporating a venturi assembly in accordance with an exemplary but nonlimiting embodiment of the invention.
Figure 4:
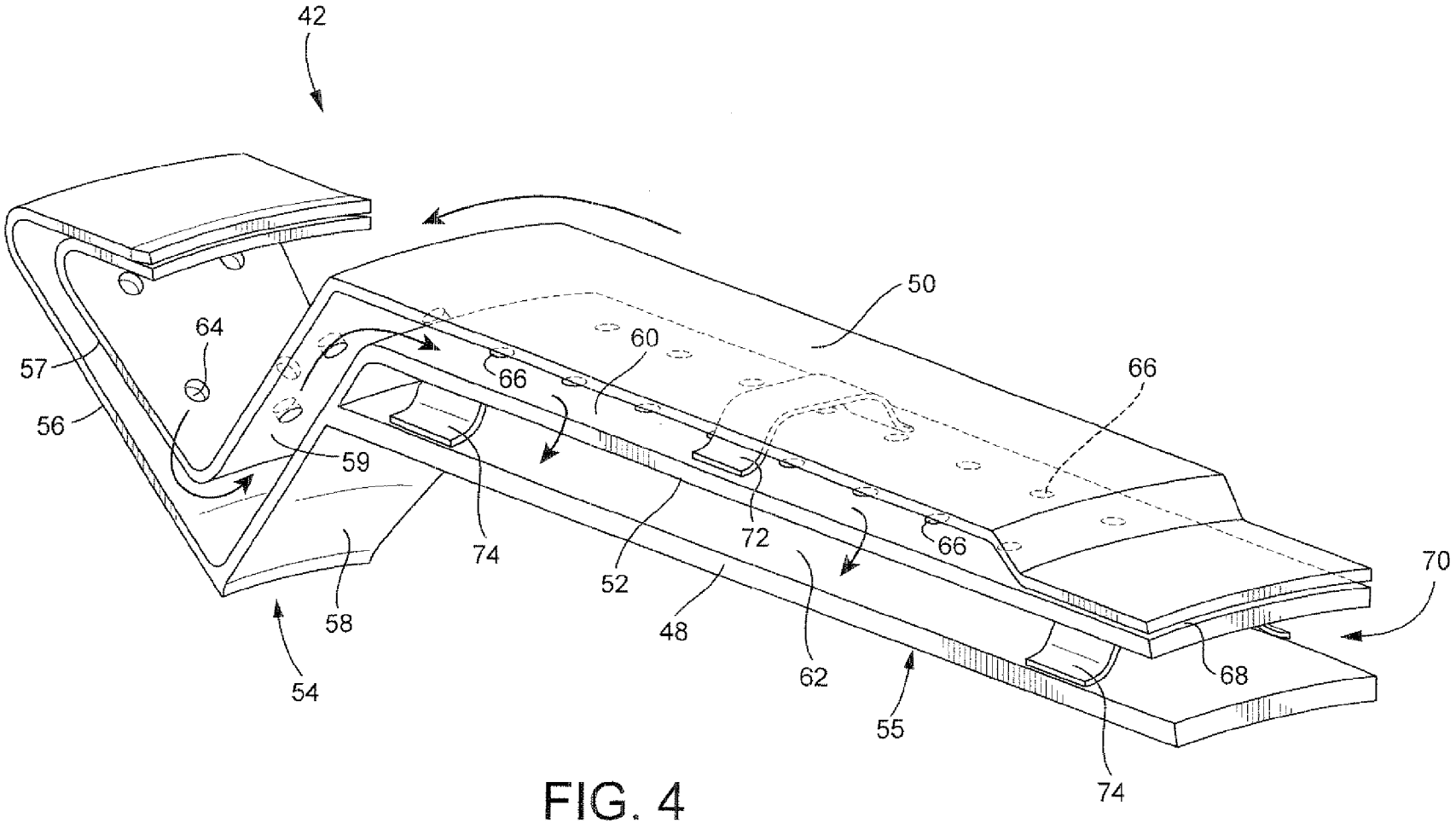
FIG. 4 is a sectioned partial perspective view of the venturi assembly shown in FIG. 3, but removed from the combustor.

Turning to FIGS. 3 and 4 in an exemplary but nonlimiting embodiment of the invention, that it is illustrated that increases cooling effectiveness of the venturi while also reducing/mitigating venturi assembly dynamics.

As in the first-described known configuration, a combustor 42 includes a combustor liner 44 defining a combustion chamber, with a venturi assembly 46 located internally of the liner. The venturi assembly 46 in the exemplary embodiment incorporates an intermediate wall in the aft, axially-extending portion of the venturi assembly, between the inner hot side wall and the outer cold side wall. Specifically, the venturi assembly 46 includes radially inner hot side wall 48, a radially outer cold side wall 50 and an intermediate wall 52. The throat region 54 is formed to include forward angled wall sections 56, 57 and aft angled wall sections 58, 59. The intermediate wall 52 extends from the aft wall section 58 to the aft end of the venturi assembly. In this manner, a first radially outer coolant flow path or passage 60 is established through the throat region 54 and continuing along the aft, axially-extending portion 55, and a second radially inner coolant flow path or passage 62 is established along just the aft, axially-extending portion 55. The radially innermost hot side wall 48 joins to the intermediate wall 52 at the aft end of the venturi throat region 54, so that the second radially inner passage 62 is closed at the aft end of the throat region 54.

A plurality of impingement holes 64 are formed in the forward and aft wall sections 57, 59 in the throat region 54 while a second plurality of impingement holes 66 are formed in the aft, axially-extending portion of the intermediate wall 52.

Note that the aft end of the outer cold side wall 50 is pinched dawn to provide only a narrow gap 68 between the outer wall 50 and the intermediate wall 52. This means that some portion of the compressor discharge air flowing along passage 60 will escape through the narrow gap 68 directly into the flow of hot combustion gases, but the majority of the cooling air will flow through the impingement holes 66 and into the radially inner passage 62 where it will impinge on and cool the radially inner hot wall 48 along the axially-extending portion 55 of the venturi assembly. The air will then exit the aft, axially-oriented opening 70 and mix with the hot combustion gases. As a result, the inner hot side wall 48 of the venturi assembly is impingement-cooled not only at the throat region 54 but also along the axial portion of the inner hot wall 48.

Separators 72 (one shown in FIGS. 3 and 4) are employed to maintain the flow passage 60 fully open during operation. Similarly, separators 74 are employed to maintain spacing between the inner wall 48 and the intermediate wall 52. As in the previously-described embodiment, a gap remains between the outwardly-bowed center portions regions of the separators and the surface of the immediately-radially outer adjacent walls 52, 50, to accommodate thermal growth during operation.

With reference now to FIGS. 5 through 9, it will be appreciated that the impingement holes 66 may be formed in various patterns about the annular surface of the intermediate wall 52 in the aft, axially-extending portion 55. For example, in FIG. 5, a pattern 76 of uniformly-spaced impingement cooling holes 77 are provided in annular rows, with the holes in axially-adjacent rows circumferentially offset. It will be understood, however that the adjacent rows could also be uniformly-aligned with no offset.

Figure 5:
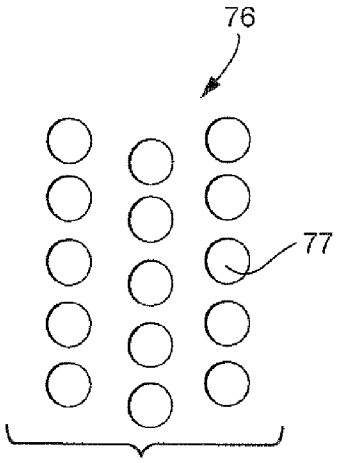
FIGS. 5-9 illustrates various impingement hole patterns that may be used in the venturi assembly shown in FIGS. 3 and 4.
Figure 6:
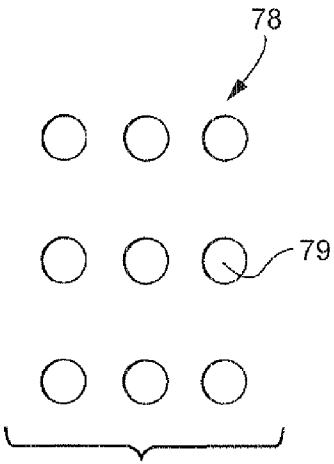
Figure 7:
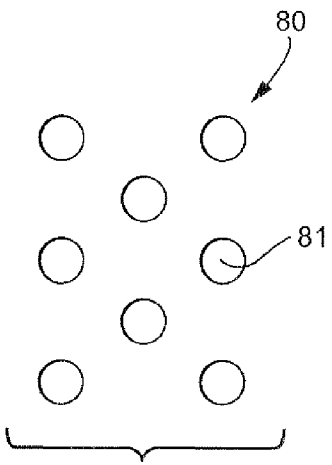
Figure 8:
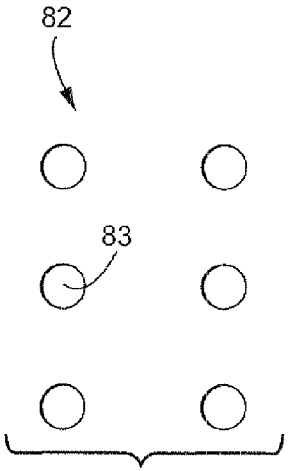
Figure 9:
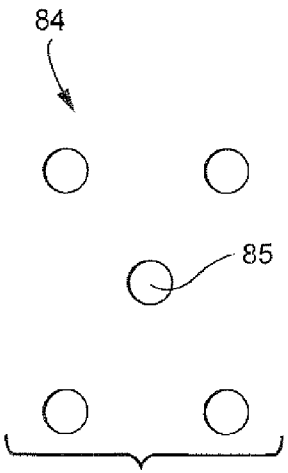

FIG. 6 illustrates another pattern 78 where the circumferential spacing between the impingement cooling holes in the otherwise regularly aligned rows is increased relative to the spacing between the holes in FIG. 5. In FIG. 7, a pattern 80 is similar to the pattern 78 in FIG. 6 except that the holes 81 in adjacent rows are circumferentially-offset. In FIG. 8, the pattern 82 of impingement cooling holes is altered to increase not only the spacing between the holes in the circumferential direction, but also the spacing of the rows of holes in the axial direction. The pattern 84 in FIG. 9 is similar to that in FIG. 8 except that there is an intermediate row of impingement cooling holes 85 where the holes are offset in the circumferential direction.

In other variations, the impingement holes may be straight, i.e. perpendicular to the wall 60, or they may be slanted at an acute angle in either the forward or aft direction. In addition, the holes need not be circular but could have an oval or racetrack-shape.

By eliminating the turbulators and utilizing the impingement cooling, it has been found the cooling efficiency is improved and dynamics caused by vortex shedding is substantially eliminated.

Another advantage of the venturi assembly illustrated in FIGS. 3 and 4 is that it can be retrofit to combustor liners already in use. To install the venturi assembly 45, the liner is removed from the combustor, and the outer diameter expanded as shown in FIG. 3 to accommodate the new venturi assembly. The venturi assembly may be secured by the rivets 20 and the liner reinstalled in the combustor. The venturi assembly 46 could, of course, also be installed at the manufacturing stage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A venturi assembly for a turbine combustor comprising:

a first outer annular wall and a second intermediate annular wall radially spaced from each other in substantially concentric relationship, said first outer annular wall and said second intermediate annular wall shaped to define a forward, substantially V-shaped throat region, and an aft, axially extending portion, wherein the first outer annular wall is a combustor liner;

a third radially innermost continuous impermeable annular wall connected to said second intermediate annular wall at an aft end of said throat region;

a first plurality of apertures in said first outer annular wall in said substantially V-shaped throat region;

a second plurality of apertures in said second intermediate annular wall along said aft, axially extending portion, and a flow passage defined by the third radially innermost continuous impermeable annular wall and the second intermediate annular wall, wherein the flow passage is continuous in an axial direction between a flow outlet at axial ends of the third radially innermost continuous annular wall and the second intermediate annular wall and flow inlets formed by the second plurality of apertures.

2. The venturi assembly of claim 1 wherein said first outer annular wall is joined to said second intermediate annular wall at a forward end of said substantially V-shaped throat region.

3. The venturi assembly of claim 2 wherein a first coolant flow passage is provided between said first outer annular wall and said second intermediate annular wall, from said throat region through an aft end of said aft, axially extending portion with cooling air supplied to said first coolant flow passage through said first plurality of apertures; and wherein the flow passage is a second cooling flow passage is provided between said second intermediate annular wall and said third radially innermost annular wall, along said aft, axially-extending portion such that cooling air in said first coolant flow passage enters said second coolant flow passage through said second plurality of apertures to thereby impingement cool said third radially-innermost annular wall.

4. The venturi assembly of claim 3 wherein said second coolant flow passage is open at said aft end of said aft, axially-extending portion.

5. The venturi assembly of claim 4, wherein said second coolant flow passage is a continuous space configured to allow flow from the second impingement holes closest to the throat region to travel the length of the third annular wall.

6. A venturi assembly of claim 3 wherein said first coolant flow passage is pinched at said aft end of said axially extending portion.

7. A venturi assembly of claim 6, wherein said pinched first coolant flow terminates such that air flowing through pinched first coolant flow passage flows directly into a flow of hot combustion gases.

8. The venturi assembly of claim 1 including one or more radial spacers between said first outer annular wall and said second annular wall, said one or more radial spacers not in contact with said first outer annular wall when cold.

9. The venturi assembly of claim 1 including one or more radial spacers between said second intermediate annular wall and said third radially innermost annular wall, said one or more radial spacers not in contact with said second intermediate annular wall when cold.

10. A turbine combustor comprising a substantially cylindrical combustor liner defining a combustion chamber; and an annular venturi assembly secured to an inner surface of said combustor liner;

said venturi assembly comprising a first outer annular wall and a second intermediate annular wall radially spaced from each other in substantially concentric relationship, said first outer annular wall and said second intermediate annular wall shaped to define a forward, substantially V-shaped throat region and an aft, axially extending portion;

a third inner continuous impermeable annular wall radially inward of said second intermediate annular wall and connected to said second inner annular wall at an aft end of said throat region;

a first plurality of apertures in said first outer annular wall in said substantially V-shaped throat region;

a second plurality of apertures in said second intermediate annular wall along said aft, axially extending portion and a flow passage defined by the third radially innermost continuous impermeable annular wall and the second intermediate annular wall, wherein the flow passage is continuous in an axial direction and includes a flow outlet at axial ends of the third radially innermost continuous annular wall and the second intermediate annular wall, and flow inlets formed by the second plurality of apertures.

11. The turbine assembly of claim 10 wherein said second plurality of apertures in said second intermediate annular wall are arranged in regular, equally-spaced, axially and radially aligned rows.

12. The turbine assembly of claim 10 wherein said second plurality of apertures in said second intermediate annular wall are arranged in equally axially and radially spaced rows where alternating rows are circumferentially staggered.

13. The turbine assembly of claim 10 wherein said first outer annular wall is joined to said second intermediate annular wall at a forward end of said substantially V-shaped throat region.

14. The turbine assembly of claim 10 wherein a second coolant flow passage is open at an aft end of said aft, axially-extending portion.

15. The turbine assembly of claim 10 wherein a first coolant flow passage is pinched at an aft end of said aft, axially extending portion.

16. The turbine assembly of claim 10 including one or more radial spacers between said first outer annular wall and said second intermediate annular wall.

17. The turbine assembly of claim 10 including one or more radial spacers between said second intermediate annular wall and said third inner annular wall.

* * * * *

UNITED STATES PATENT AND TRADEMARK OFFICE

CERTIFICATE OF CORRECTION

PATENT NO. : 8,931,280 B2
APPLICATION NO. : 13/094160
DATED : January 13, 2015
INVENTOR(S) : Karthick Kaleeswaran et al.

It is certified that error appears in the above-identified patent and that said Letters Patent is hereby corrected as shown below:

In the Specification

At Column 2, line 62, reads --side wall when cold, so as to accommodate thermal growth--, should read "side wall 18 when cold, so as to accommodate thermal growth"

At Column 3, line 52, reads --pinched dawn to provide only a narrow gap 68 between the--, should read "pinched down to provide only a narrow gap 68 between the"

At Column 4, line 18, reads --spacing between the impingement cooling holes in the--, should read "spacing between the impingement cooling holes 79 in the"

At Column 4, line 23, reads --pattern 82 of impingement cooling holes is altered to increase--, should read "pattern 82 of impingement cooling holes 83 is altered to increase"

At Column 4, line 41, reads --already in use. To install the venturi assembly 45, the liner is--, should read "already in use. To install the venturi assembly 45, the liner 44 is"

At Column 5, line 25, reads --passage is a second cooling flow passage is provided between--, should read "passage is a second cooling flow passage provided between"

Signed and Sealed this
Twenty-first Day of April, 2015

Michelle K. Lee

Michelle K. Lee
*Director of the United States Patent and Trademark Office*